US008863332B2

(12) United States Patent
Rohr

(10) Patent No.: US 8,863,332 B2
(45) Date of Patent: Oct. 21, 2014

(54) ARTICULATING MATTRESS WITH EMBEDDED DECK

(71) Applicant: L & P Property Management Company, South Gate, CA (US)

(72) Inventor: William Robert Rohr, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 49 days.

(21) Appl. No.: 13/653,822

(22) Filed: Oct. 17, 2012

(65) Prior Publication Data

US 2014/0101863 A1 Apr. 17, 2014

(51) Int. Cl.
*A47B 7/02* (2006.01)

(52) U.S. Cl.
USPC ..... 5/618; 5/720; 5/617; 5/655; 5/716

(58) Field of Classification Search
CPC .... A47C 23/005; A47C 20/04; A47D 15/001; A47D 5/006; A47D 7/002; A47D 9/005
USPC ..... 5/723, 655.9, 657, 640, 720, 705, 717, 5/722, 728, 740
See application file for complete search history.

(56) References Cited

U.S. PATENT DOCUMENTS

| | | | | | |
|---|---|---|---|---|---|
| 2,956,290 | A * | 10/1960 | Scheinerman | ..... | 5/308 |
| 3,646,621 | A * | 3/1972 | Fragas | ..... | 5/617 |
| 3,693,200 | A * | 9/1972 | Stafford | ..... | 5/617 |
| 4,899,404 | A * | 2/1990 | Galumbeck | ..... | 5/616 |
| 5,577,280 | A * | 11/1996 | Elliott | ..... | 5/618 |
| 5,640,730 | A | 6/1997 | Godette | | |
| 5,791,001 | A * | 8/1998 | Wang | ..... | 5/716 |
| 6,008,598 | A | 12/1999 | Luff et al. | | |
| 6,088,857 | A * | 7/2000 | Ogle | ..... | 5/722 |
| 6,396,224 | B1 | 5/2002 | Luff et al. | | |
| 7,395,568 | B2 * | 7/2008 | Damewood | ..... | 5/722 |
| 7,475,441 | B1 * | 1/2009 | Soberal | ..... | 5/655 |
| 7,900,302 | B2 * | 3/2011 | Long | ..... | 5/618 |
| 8,266,746 | B2 * | 9/2012 | Oh et al. | ..... | 5/722 |
| 2005/0055779 | A1 * | 3/2005 | Damewood | ..... | 5/722 |
| 2008/0262657 | A1 | 10/2008 | Howell et al. | | |
| 2009/0211028 | A1 * | 8/2009 | Richmond et al. | ..... | 5/618 |
| 2010/0186168 | A1 * | 7/2010 | Harrison | ..... | 5/616 |
| 2012/0102646 | A1 * | 5/2012 | Chen et al. | ..... | 5/499 |

* cited by examiner

*Primary Examiner* — Robert G Santos
*Assistant Examiner* — Myles Throop
(74) *Attorney, Agent, or Firm* — Shook, Hardy & Bacon L.L.P.

(57) ABSTRACT

An adjustable bed is provided that has an articulating mattress a number of articulating sections. The bed has an adjustable base with a mechanism to move the articulating mattress into a plurality of positions. The articulating mattress has a number of rigid deck boards. Each articulating section has a corresponding deck board. Adjacent deck boards are hinged together so they can move or rotate with respect to one another. A suspension material, such as pocketed coil springs and/or foam, is disposed above each of said deck boards. A surrounding covering material that encases the deck boards and the suspension material to provide a mattress that can be moved to a number of different positions without any further retaining mechanisms being needed.

18 Claims, 4 Drawing Sheets

ARTICULATING MATTRESS WITH EMBEDDED DECK

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to an articulating mattress for use on an adjustable bed. More particularly, the invention relates to an articulating mattress having an embedded deck that can be directly coupled to an articulating mechanism.

BACKGROUND OF THE INVENTION

A well-known type of bedding product comprises a motorized adjustable bed in which an articulated frame supports a mattress. These motorized adjustable beds have traditionally been used in hospitals but more and more are being installed and used in residential homes. Motorized adjustable beds conventionally have an upper body support movable between an inclined position in which it supports the person in a sitting position and a prone position in which the person can lay flat. In addition, a leg support is movable between positions and may be adjusted so that the foot section is elevated. These sections together make up what is known as the decking of the bed. An actuating mechanism, commonly two or more electric motors or actuators, raises and lowers the adjustable sections. The mattress of the bed typically rests upon the decking and moves as the decking moves. As the mattress moves with the decking, it is necessary to retain the mattress in place relative to the decking.

A variety of methods are used to prevent a mattress from shifting past the edge of the decking. Traditional mattress-retention methods include foot retainer bars, snaps, zippers, buckles, bars, Velcro®, clips, pockets, and non-slip fabrics or surfaces. Many of these methods help prevent a mattress from moving towards the foot end of an automated bed during base articulation, such as during articulation of a Power Foundation from Leggett & Platt®. However, these methods may be unsightly to a user, especially for use in a residential environment. When used in a residential environment, the retainer bars and other mechanisms traditionally used to retain the mattress in place tend to make the bed appear more like a "hospital bed" which can be undesirable. These mechanisms may also complicate the use of traditional bedding materials such as sheets or blankets on the bed.

Accordingly, a need exists for an adjustable mattress for use on adjustable beds that can be maintained in position during articulation, without a need for external retaining mechanisms.

BRIEF SUMMARY OF THE INVENTION

The present invention generally relates to an adjustable bed that has an articulating mattress a number of articulating sections. The bed has an adjustable base with a mechanism to move the articulating mattress into a plurality of positions. The articulating mattress has a number of rigid deck boards.

Each articulating section has a corresponding deck board. Adjacent deck boards are hinged together so they can move or rotate with respect to one another. A suspension material, such as pocketed coil springs and/or foam, is disposed above each of said deck boards. A surrounding covering material that encases the deck boards and the suspension material to provide a mattress that can be moved to a number of different positions without any further retaining mechanisms being needed.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
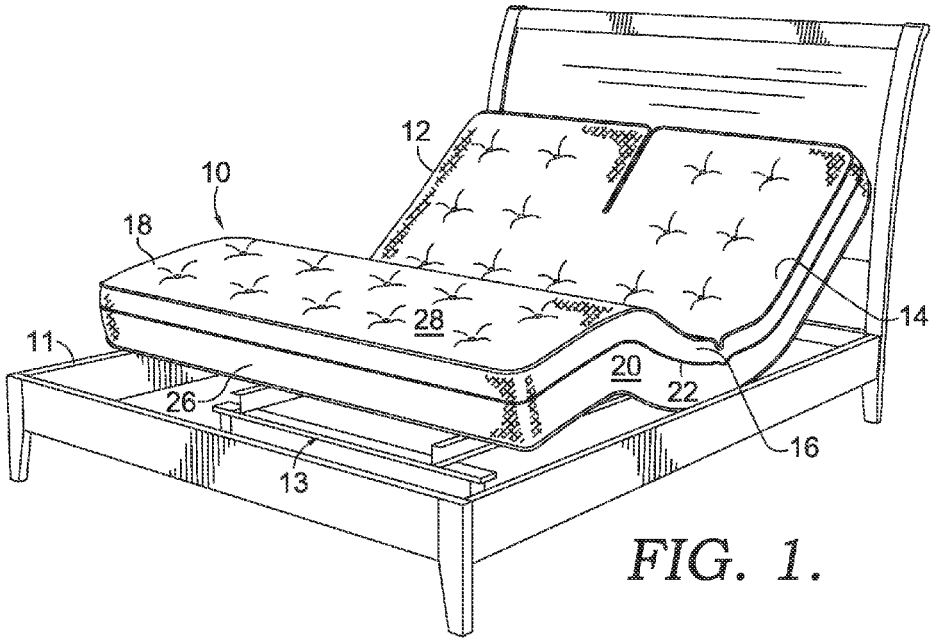
FIG. 1 is a perspective view of an adjustable mattress installed on an adjustable bed.

An embodiment of an articulated mattress 10 is illustrated in FIG. 1. In FIG. 1, the mattress 10 is shown installed on a bed 11 with an adjustable base 13. Mattress 10 includes a head section 12, a chest or torso section 14, a thigh section 16 and a foot section 18. Sections 12, 14, 16 and 18 can be manipulated into various positions, through adjustable base 13, as further described below. The entire mattress 10 is encased in a fabric shell 20. Preferably, shell 20 has a zipper 22 extending around the sides, near the upper portion of the mattress 10. Zipper 22, or other releasable enclosure mechanisms, allows access to the interior of the mattress. Shell 20 has a lower border 24 (see FIG. 4), upstanding sides 26 (though which zipper 22 passes) and a top 28.

Figure 2:
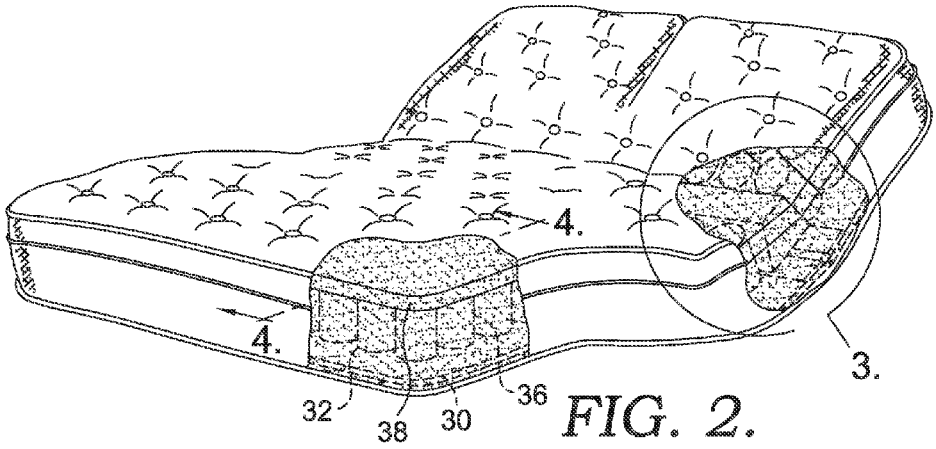
FIG. 2 is a view of the mattress of FIG. 1, shown with parts broken away to show interior details of construction.
Figure 3:
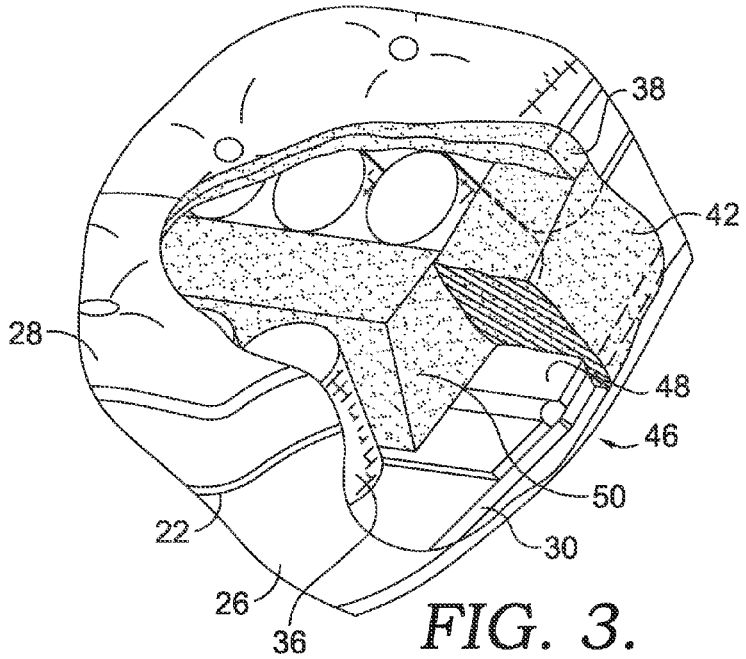
FIG. 3 is an enlarged view of the encircled region 3 of FIG. 2.
Figure 4:
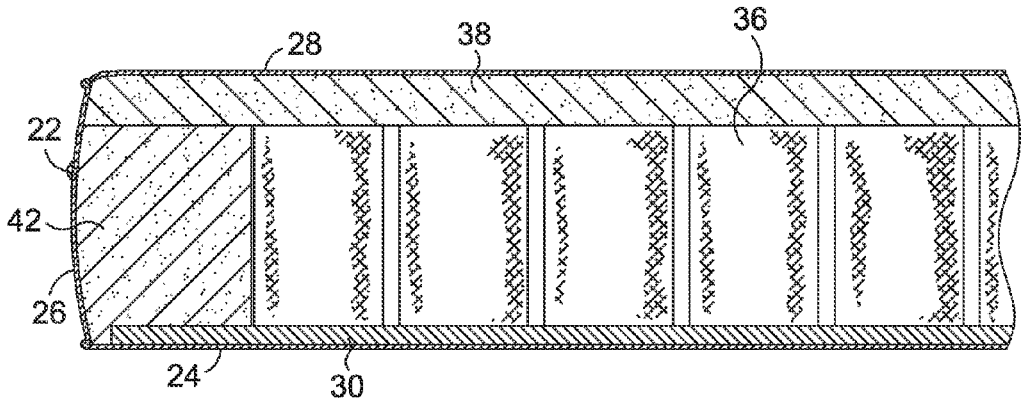
FIG. 4 is a partial cross-section view taken along line 4-4 of FIG. 2.
Figure 5:
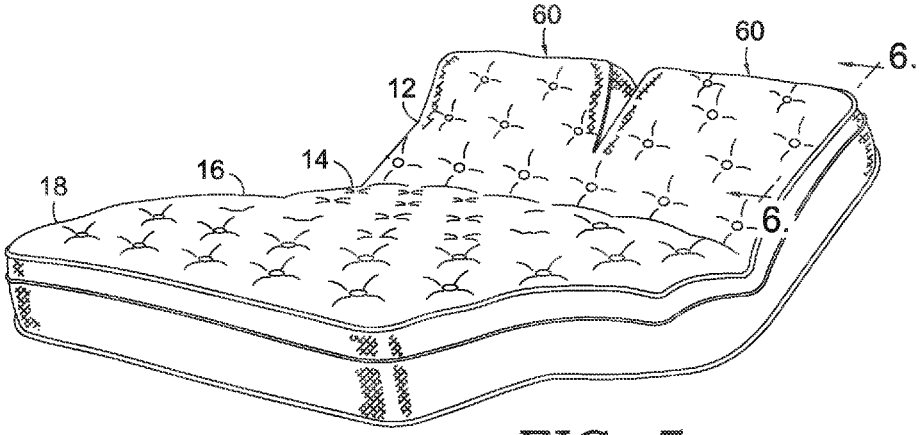
FIG. 5 is a view similar to FIG. 2, showing one pillow section elevated.
Figure 6:
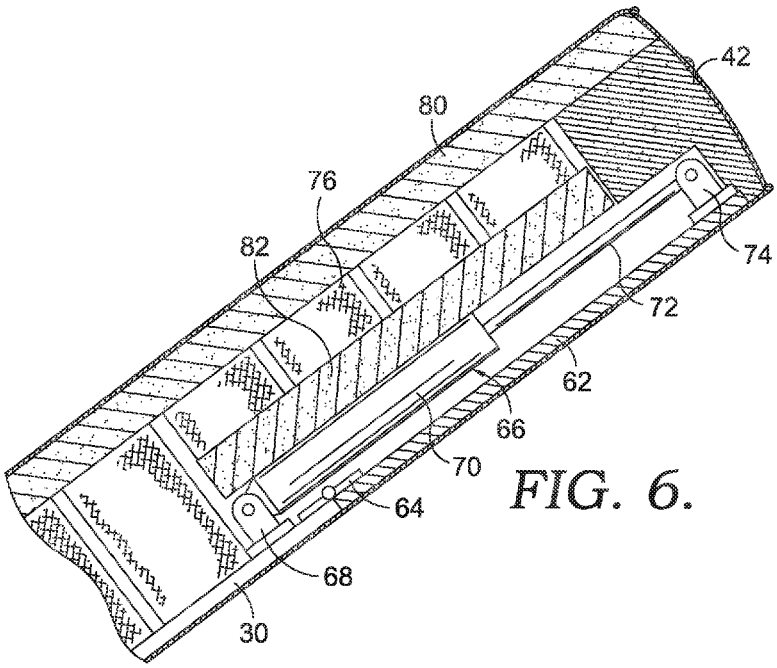
FIG. 6 is a partial cross-section view taken along line 6-6 of FIG. 5.

Each of sections 14, 16 and 18 has a similar interior construction. FIG. 2 illustrates section 18, with certain portions broken away or pealed back to show interior details. As seen in FIG. 2, mattress 10 includes a deck board 30 at the bottom of the mattress. Deck board 30 is a rigid material, such as, for example plywood sheeting. A suspension material, such as a pocketed coil unit 32 is disposed on top of the deck board 30, and is secured to the deck board. The pocketed coils 32 can be, for example, glued and stapled to the deck board 30. As is known to those of skill in the art, the pocketed coil unit 32 includes a grid of coil springs; each separated and held within a fabric "pocket" 36. A coil protection pad & comfort layer 38 is disposed on top of the pocketed coil unit 32. The comfort layer 38 functions to further evenly distribute the weight of a person resting on the mattress and to prevent the person from feeling individual springs. In addition, different mattress characteristics can be achieved by varying the materials and thicknesses of the comfort layer 38. It should also be understood that the coil protection pad and comfort layer 38 can be separated and provided as two separate pieces. It should also be understood that other materials, beyond pocketed coil springs, could be used as a suspension material. Preferably, the comfort layer 38 is accessible using the zipper 22. As best seen in FIGS. 3 and 4, a foam shroud 42 forms an outer border that wraps around the pocketed coil unit 32 and the deck board 30.

As best seen in FIG. 3, a transition area 46 separates each of the sections. FIG. 3 illustrates a transition area between sections 14 and 16. Each transition area 46 accommodates bending of the mattress 10 into one of several articulated positions known in the art. For example, the mattress 10 can be positioned flat, with an elevated head section 12, with an elevated thigh and foot sections 16, 18, or with both head section 12 and thigh and foot sections 16, 18 elevated. The deck boards 30 of the two adjoining sections are coupled to one another with a hinge 48. The hinge 48 allows the adjoining deck boards 30 to pivot relative to one another in a controlled fashion. The transition area can be constructed such that the adjacent pocketed coil units 32 are located such that they are directly adjacent one another. Alternatively, a transition block 50 may be located between adjacent pocketed coil units 32. Block 50 can be constructed from a foam material and can be located directly over the hinge 48.

Figure 7:
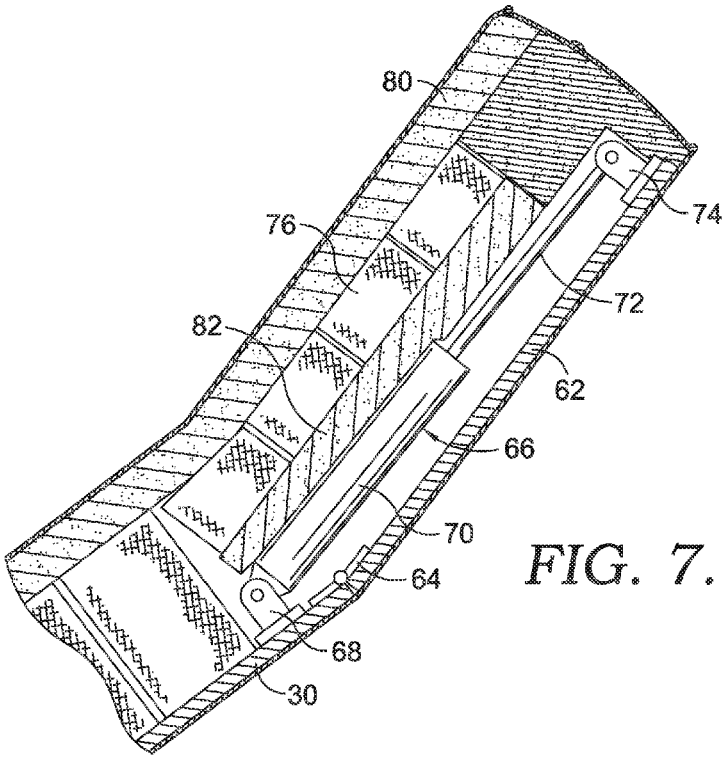
FIG. 7 is view similar to FIG. 6, but with one pillow section elevated.
Figure 8:
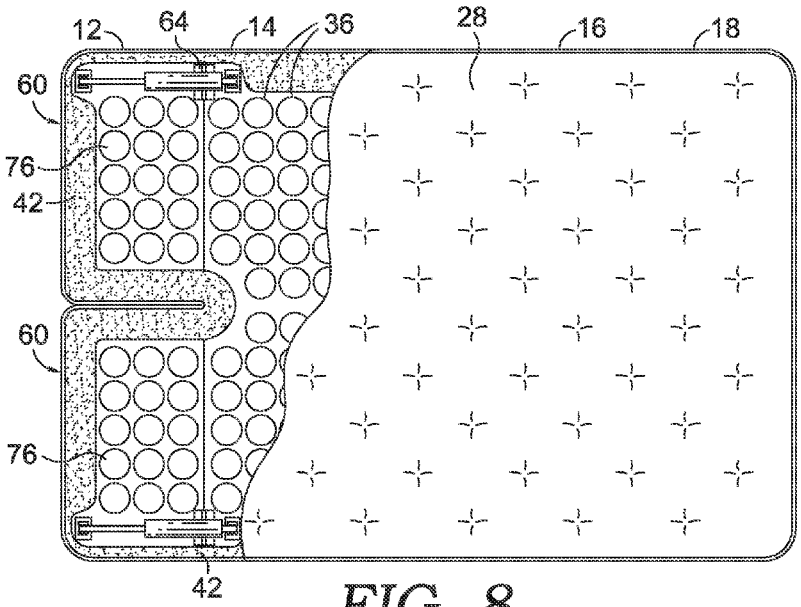
FIG. 8 is a top view with sections removed to show details of construction.

Mattress 10 further includes an integral pillow-tilt section 60, as best seen in FIGS. 5-8. Preferably, mattress 10 is formed with two separate and independent pillow-tilt sections 60, one for each side of the bed. The pillow-tilt sections are operable to raise and lower a portion of the head section 12 of the mattress 10. Each section 60 has a deck board 62, similar to deck boards 30. In this preferred embodiment with two pillow-tilt sections 60, each deck board 62 extends only half way across mattress 10. The deck boards 62 are each coupled independently to the adjacent deck board 30 with a hinge 64. A pillow-tilt mechanism 66 also couples the pillow-tilt section 60 to the adjacent head section 12. As best seen in FIGS. 7 and 8, a first bracket 68 is coupled to deck board 30 immediately adjacent deck board 62. A pillow-tilt motor 70 has one end pivotably coupled to the bracket 68. The motor 70 operates to extend and retract a shaft 72 that is pivotably coupled to a bracket 74. The bracket 74 is mounted directly to deck board 62. The motor 70 is operable to extend and retract the shaft 72. As the shaft retracts, (FIG. 7), the deck board 62 pivots upwardly, and as the shaft extends, the deck board 62 pivots downwardly. Therefore, the motor 70 is operable to raise and lower the respective pillow-tilt section 60. The remainder of pillow-tilt section 60 can be constructed similarly to the other sections 12-18 described above, with a pocketed spring coil unit 76 mounted to the deck board 62, along with a pad and comfort layer 80. In addition, the area around motor 70 can be filled with a sound and vibration damping material, such as a foam 82. Other types of mechanisms could also be used in place of motor 70, such as a linear actuator or gas cylinder. Moreover, only one pillow-tilt section 60 may be needed, such as in a mattress 10 configured in a twin or double size.

In operation, mattress 10 can be installed on any of a number of power adjustable foundation beds. These beds have the mechanisms 13 and controls to manipulate the mattress 10 into the various positions described above. Mattress 10 can be directly mounted to the foundation, such as by coupling the deck boards 30 to the operating hardware of the foundations 13. Due to this direct mounting, and the incorporation of the deck boards within the mattress 10, there is no need for any other mattress retaining mechanisms, such as those now found on existing adjustable beds. This gives the bed a cleaner look that is more like a traditional bed and less like a "hospital bed."

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mattress for an adjustable bed comprising:

a plurality of articulating sections;

a plurality of rigid deck boards each corresponding to one of the articulating sections, adjacent deck boards being hingedly coupled together;

a suspension material disposed above each of the deck boards;

a surrounding covering material that encases the deck boards and the suspension material; and at least one mechanism coupling adjacent deck boards and configured to rotate one of the immediately adjacent deck boards with respect to another one of the immediately adjacent deck boards, wherein the at least one mechanism is encased by the surrounding covering material.

2. The mattress of claim 1, wherein the suspension material is spaced inwardly from an outer boarder, the mattress further comprising an outer foam border extending substantially around the outer border of the mattress and inside of the surrounding covering material.

3. The mattress of claim 1, further comprising an additional foam comfort layer disposed above the suspension material.

4. The mattress of claim 1, further comprising a releasable enclosure mechanism extending around a perimeter of the covering material and operable to gain access to the interior of the covering material.

5. The mattress of claim 1, wherein one of the articulating sections is a head section, and wherein the head section includes a pillow-tilt section.

6. The mattress of claim 5, wherein there are two adjacent and independent pillow-tilt sections.

7. The mattress of claim 6, wherein each pillow-tilt section includes a deck board that is independently hinged to the deck board of the articulating section immediately adjacent the pillow-tilt section, further comprising a mechanism coupling the deck board of the adjacent articulating section to the deck board of the corresponding pillow-tilt section, the mechanism operable to rotate the pillow-tilt section with respect to the adjacent articulating section.

8. An adjustable bed comprising:

an articulating mattress having a plurality of articulating sections;

an adjustable base having a first mechanism to move the articulating mattress into a plurality of positions;

the articulating mattress having a plurality of rigid deck boards, where each deck board corresponds to one of the articulating sections, and where adjacent deck boards are coupled together such that each can be angularly displaced with respect to an adjacent deck board;

a suspension material disposed above each of the deck boards;

a surrounding covering material that encases the deck boards and the suspension material; and at least one second mechanism coupling immediately adjacent deck boards and configured to rotate one of the immediately adjacent deck boards with respect to another one of the immediately adjacent deck boards, wherein the at least one second mechanism is encased by the surrounding covering material.

9. The adjustable bed of claim 8, wherein the suspension material is a series of pocketed coil units, each unit being coupled to a corresponding deck board.

10. The adjustable bed of claim 9, wherein the pocketed coils are spaced inwardly from an outer boarder, the mattress further comprising an outer foam border extending substantially around the outer border of the mattress and inside of the surrounding covering material.

11. The adjustable bed of claim 10, further comprising an additional foam comfort layer disposed above the suspension material.

12. The adjustable bed of claim 11, further comprising a zipper extending around a perimeter of the covering material and operable to gain access to the interior of the covering material.

13. The adjustable bed of claim 12, wherein one of the articulating sections is a head section, and wherein the head section includes a pillow-tilt section.

14. The adjustable bed of claim 13, wherein there are two adjacent and independent pillow-tilt sections.

15. The adjustable bed of claim 14, wherein each pillow-tilt section includes a deck board that is independently hinged to the deck board of the articulating section immediately adjacent the pillow-tilt section, further comprising the at least one second mechanism coupling the deck board of the adjacent articulating section to the deck board of the corresponding pillow-tilt section, the at least one second mechanism operable to rotate the pillow-tilt section with respect to the adjacent articulating section.

16. A mattress for use in an adjustable bed, comprising:

a plurality of rigid deck boards, each defining one of a plurality of articulating sections, wherein adjacent deck boards being coupled together to allow relative movement between adjacent deck boards;

a suspension material disposed above each of the deck boards;

a surrounding covering material that encases the deck boards and the suspension material; and at least one mechanism coupling immediately adjacent deck boards and configured to rotate one of the immediately adjacent deck boards with respect to another one of the immediately adjacent deck boards, wherein the at least one mechanism is encased by the surrounding covering material.

17. The mattress of claim 16, wherein one of the articulating sections is a section at the head of the bed, the mattress further comprising:

a pillow-tilt section immediately adjacent the head section, the pillow-tilt section having a rigid deck board coupled to the deck board of the head section via a hinge, the pillow-tilt section further having the at least one mechanism coupling the deck board of the pillow-tilt section to the deck board of the head section, the at least one mechanism operable to rotate the pillow-tilt section with respect to the head section.

18. The mattress of claim 17, wherein the head section extends substantially across the width of the mattress, and wherein two pillow-tilt sections are provided, each extending only half-way across the width of the bed.

* * * * *